United States Patent [19]

Mabe, Jr.

[11] 4,131,386

[45] Dec. 26, 1978

[54] SEALING SYSTEM FOR CENTRIFUGAL PUMP

[75] Inventor: William J. Mabe, Jr., Thornton, Colo.

[73] Assignee: Sundstrand Corporation, Rockford, Ill.

[21] Appl. No.: 794,170

[22] Filed: May 5, 1977

[51] Int. Cl.[2] ..... F01B 11/08

[52] U.S. Cl. ..... 415/98; 415/170 A; 415/171

[58] Field of Search ..... 415/104, 105, 107, 169 R, 415/169 A, 170 R, 170 A, 171, 172, 173 R, 173 A, 98; 277/53, 54

[56] References Cited

U.S. PATENT DOCUMENTS

| | | | |
|---|---|---|---|
| 1,823,702 | 9/1931 | Ring | 415/171 |
| 3,516,757 | 6/1970 | Baumann | 415/171 |
| 3,628,881 | 12/1971 | Herrmann | 415/170 A |
| 3,817,653 | 6/1974 | Onal | 415/169 A |

FOREIGN PATENT DOCUMENTS

| | | | |
|---|---|---|---|
| 730357 | 5/1955 | United Kingdom | 415/170 A |

*Primary Examiner*—Louis J. Casaregola
*Attorney, Agent, or Firm*—Ted E. Killingsworth; William R. Peoples; Michael B. McMurry

[57] ABSTRACT

A double suction, high-speed centrifugal pump includes an impeller with shrouds formed integrally with opposite sides thereof. The impeller is splined on a rotatable shaft within a chamber in a housing. Sealing rings are fixed within the chamber and axially facing sealing surfaces and walls are formed in the shrouds and sealing rings respectively to help keep liquid from leaking from the impeller discharge and back to the inlet of the impeller. Means are provided for adjusting the axial distance between each of the sealing walls of the two shrouds and the center of the impeller chamber. Also, means are provided for locating the impeller axially within the impeller chamber to precisely position the sealing surfaces with respect to the sealing walls.

2 Claims, 1 Drawing Figure

SEALING SYSTEM FOR CENTRIFUGAL PUMP

BACKGROUND OF THE INVENTION

The present invention relates to a high-speed centrifugal pump and, more particularly, to an improvement in the construction and mounting of a sealing ring in the centrifugal pump to help keep discharge fluid from leaking back to the inlet of the impeller. Herein, the impeller is mounted upon a rotatable shaft journaled within the housing so as to draw fluid through an inlet and to discharge the fluid at an increased head through an outlet as the shaft is rotated. The body of the impeller in conjunction with the blades and a shroud define flow passages through which the fluid flows from the inlet to the outlet. Desirably, the shroud is integrally formed with the impeller and the sealing ring is mounted within the housing closely adjacent the impeller shroud to help keep the discharge fluid from leaking back to the inlet.

One high-speed centrifugal pump of the foregoing general type is disclosed in U.S. Pat. No. 3,817,653.

SUMMARY OF THE INVENTION

The primary aim of the present invention is to provide a more efficient high-speed centrifugal pump of the foregoing general character by reducing recirculation leakage between the pump impeller discharge and inlet. A more detailed object is to achieve the foregoing through the provision of a unique arrangement for minimizing leakage across opposing axial end faces of the impeller shroud and the sealing ring instead of the adjacent radial surfaces of the shroud and of the sealing ring.

A more specific object is to provide means for precisely positioning the opposing axial end faces of the shroud and sealing ring relative to each other so as to avoid metal to metal contact between such opposing faces while still minimizing leakage between the impeller inlet and discharge.

As particularly applied to a double suction, high-speed centrifugal pump, the invention also resides in the provision of means for selective adjustment of the axial distance between the axial sealing walls of the sealing rings for receiving the impeller between such walls within extremely close tolerance limits.

Still further, the invention resides in the provision of means for centering the impeller in the space between the two sealing rings so that the distance between the sealing surfaces at each end of the impeller and the adjacent sealing walls of the sealing ring may be the same and in the combined use of the axial end faces and the radially adjacent surfaces of the shroud and sealing ring as the primary and secondary means, respectively, of reducing leakage between the impeller inlet and outlet.

These and other objects and advantages of the present invention will become more apparent from the following detailed description when taken in conjunction with the accompanying drawing.

DETAILED DESCRIPTION OF THE PREFERRED EMBODIMENT

Figure 1:
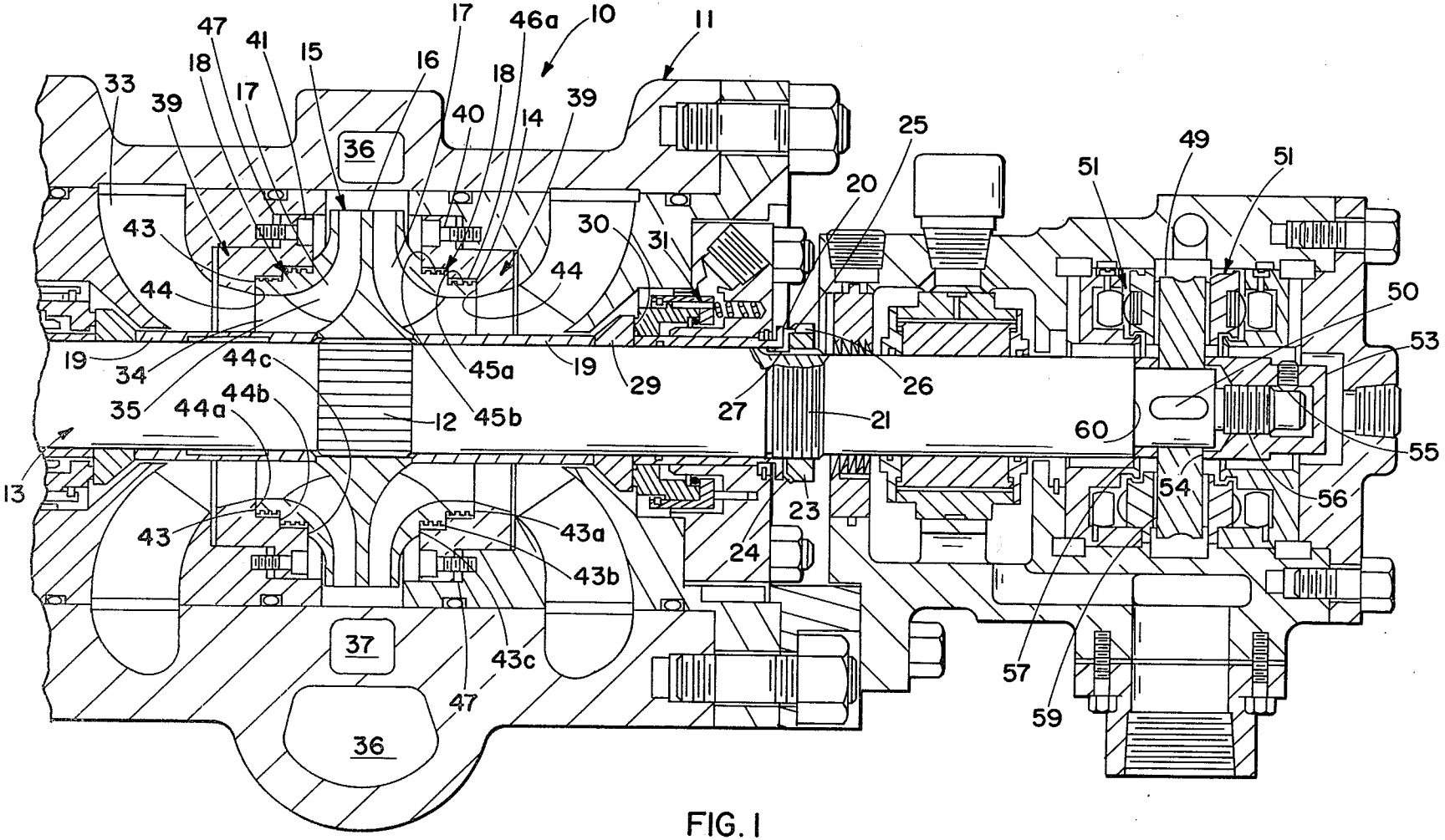
FIG. 1 is a fragmentary, axial cross-sectional view of a double suction, high-speed, centrifugal pump embodying the novel features of the present invention.

As shown in the drawing for purposes of illustration, the present invention is embodied in a centrifugal pump

10, particularly a double suction pump adapted for high-flow and high-head applications. Herein, the pump includes a housing 11 with a rotatable shaft 13 journaled therein and driven by suitable means (not shown). Mounted on the shaft within a chamber 14 in the housing is an impeller 15 including a body 16 with generally radially projecting blades 17 integrally formed on opposite sides of the body. Surrounding the blades on opposite sides of the body are shrouds 18 which are spaced from the body and integrally formed with the outer edges of the blades so that the body, blades and shrouds all rotate together with the shaft 13.

To hold the impeller against sliding in an axial direction on the splines 12, two retaining sleeves 19 are telescoped onto the shaft and abut the opposite sides of the impeller body 16. Only one of the sleeves is shown completely in FIG. 1, the left hand sleeve being identical in configuration and supported on the shaft in the same manner as the right hand sleeve. More particularly, the latter includes an outer flanged end 20 extending over a threaded segment 21 of the shaft 13 and a nut 23 is threaded onto the segment 21 of the shaft to react against the flanged end 20 of the retaining sleeve 19 and thereby support the sleeve axially on the shaft 13. Located between the nut and flange is a lock washer 24 including a peripheral tab 25 which seats within a suitable axial notch 26 formed within the periphery of the nut. The corresponding tab 27 is formed in the lock washer adjacent the central opening thereof and telescopes into the sleeve between the sleeve and the washer so that the two tabs 25 and 27 keep the nut from turning on the shaft 13. Separating the sleeve into two segments is a mating ring 29 including a radial sealing surface 30 which is engaged by suitable sealing means 31 particularly adapted to keep liquid from leaking along the sleeve and out of the housing 11 during operation of the pump.

When the pump 10 is operating, liquid is drawn into the impeller chamber 14 through an inlet 33 to flow axially along the rotating shaft 13 and into the eye 34 of the impeller. From the eye, liquid flows through passages 35 defined by the body 16, blades 17 and shroud 18 and is accelerated to exit from the impeller into discharge passages defined by angularly spaced volutes 36 and 37. The liquid entering the volutes is at a substantially higher pressure head than the inlet liquid so that there is a tendency for the higher pressure discharge liquid to leak along the outside of the shroud 18 and back toward the inlet 23. A high amount of leakage, of course, substantially reduces the efficiency of the pump 10.

In the exemplary double suction pump, to help restrict the flow of liquid from the impeller discharge to the inlet, sealing rings 39 are mounted within the impeller chamber 14, one between each of the shrouds 18 and the housing 11 in a manner so as to limit the radial clearance between the shrouds and the sealing rings. More particularly, the sealing rings are fixed within the housing against rotation while the shrouds are rotatable with the shaft 13 and, in the present instance, the means for fixing the sealing rings against rotation is in the form of screws 40 extending through peripheral lips 41 which project radially outward from the outlet ends of the sealing rings. The amount of liquid flowing between the sealing rings and the shrouds depends upon the difference in the pressure heads of the liquid at the inlet and outlet of the impeller 15. However, owing in part to the use of volute type diffusers, a pressure difference may exist on radially opposite sides of the impeller so that the rotating shaft and impeller do not follow a truly circular path. A variation from a truly circular path, of course, affects the rate of leakage between the sealing rings 39 and the impeller shrouds 18. More importantly, deflection of the impeller and shaft from a truly circular rotational path may cause undesirable wear between the sealing rings and impeller shrouds so that the extent of deflection necessarily limits the minimum clearance that might be provided between the sealing rings and impeller shrouds over the clearance that might be possible if such deflection did not occur.

In accordance with the primary aspect of the present invention, each of the two sealing rings 39 and the impeller 15 are mounted within the housing 11 in a novel manner so as to minimize clearance between the two impeller shrouds 18 and the sealing rings without regard to the deflection of the shaft 13. For this purpose, provision is made for precisely positioning axially facing sealing surfaces 43 and sealing walls 44 of the impeller shrouds and sealing rings, respectively. This is accomplished through the provision of means for selectively adjusting the axial distance between the sealing walls in the two sealing rings and through the provision of means for selective axial positioning of the impeller, and as a result, the sealing surfaces, between the sealing walls of the sealing rings. By virtue of this unique arrangement, the clearances between the sealing surfaces and sealing walls of the impeller shrouds and sealing rings, respectively, may be adjusted precisely to minimize leakage of liquid from the impeller discharge back to the impeller inlet regardless of deflection of the impeller shaft 13 while still avoiding metal to metal contact between such surfaces in the event of shaft deflection.

In the present instance, each impeller shroud 18 includes three axially spaced sealing surfaces 43, the axially outward surface being identified as sealing surface **43*a*, the intermediate sealing surface being identified as 43*b* and the axially inward sealing surface being identified as 43*c*. Not only are these three sealing surfaces spaced axially from each other, but they also are spaced radially from each other with a secondary radial sealing surface 45*a* extending between the axial sealing surfaces 43*a* and 43*b* and another similar radial sealing surface 45*b* extending between the axial surfaces 43*b* and 43*c*. As shown in FIG. 1, the radial sealing surface 45*a* is spaced radially inward from the radial sealing surface 45*b* and both of the radial sealing surfaces 45*a* and 45*b* and suitably grooved to help reduce the flow of liquid along those surfaces and thereby provide a secondary sealing function. In a similar manner, each of the sealing rings 39 is constructed to include three axially spaced sealing walls 44*a*, 44*b* and 44*c*, separated by secondary radial sealing walls 46*a* and 46*b*. In the assembled pump, the sealing surfaces 43*a*, 43*b* and 43*c* are associated with their corresponding sealing walls 44*a*, 44*b* and 44*c*, respectively. As shown in FIG. 1, the distance between the axially facing sealing surfaces 43*a*, 43*b* and 43*c* and their respective sealing walls 44*a*, 44*b* and 44*c* is less than the distance between the radial sealing surfaces 45*a* and 45*b* and their respective sealing walls 46*a* and 46*b***.

In machining the axial sealing surfaces 43 of the shrouds 18, it is possible that some variation in the axial distance from the center of the impeller body 16 to such surfaces may occur between each side of the impeller and from one impeller to the next even though the axial distances between sealing surfaces **43*a*, 43*b* and 43*c* may be the same for each side of the impeller. To assure that the clearances between the sealing surfaces of the shrouds 18 and the sealing walls 44 of the sealing rings 39 may be adjusted to be the same on opposite sides of the impeller body 16, the axial distance between the two sealing walls 44 and the axial distance between each sealing wall and the center of the impeller chamber 14 is made selectively adjustable. Herein, this is achieved by means in the form of shim rings 47 which are mounted between the sealing lips 41 and the housing 11. By virtue of the use of the shim rings 47, the sealing ring on the left may be adjusted axially within the housing to compensate for any variance in the axial distance between the sealing surfaces 43 on the left side of the impeller and the axial center of the impeller body. Similarly, the shim rings 47 between the sealing ring on the right side of the impeller may be adjusted so that the axial distance between the sealing walls of the two sealing rings is that which is required to provide the proper clearances with the sealing surfaces 43** at opposite ends of the impeller so as to keep leakage to a minimum.

In order to keep the impeller 15 from moving axially within the impeller chamber 14 during operation of the pump 10, a thrust disk 49 is secured to one end of the shaft 13. Herein, a suitable key and keyway arrangement 50 locks the thrust disk against rotation on the shaft and tilting pad thrust bearings 51 engage opposite sides of the thrust disk so that axial loads on the shaft are absorbed by the housing 11 without axial shifting of the shaft. Securing the thrust disk axially on the shaft is an internally threaded end cap 53 whose inner end 54 telescopes over the shaft and abuts the outer radial face of the thrust disk. A set screw 55 through the cap engages a reduced threaded end section 56 of a shaft to hold the cap against turning during operation of the pump.

To position the impeller 15 precisely within the impeller chamber so that the clearances between the sealing surfaces 43 and walls 44 are the same at both ends of the impeller 15, a spacer ring 57 is located between the axially inward face 59 of the thrust disk and a shoulder 60 which is formed on the shaft 13. With the tilting pad thrust bearing precisely positioned in the housing, the spacer ring 57 serves as a means for selectively adjusting the distance between the impeller and the thrust disk 49 so as to center the impeller between the two sealing rings 39. Thus, during operation of the pump, the sealing surfaces 43 are kept from moving axially to wear against the sealing walls 44 and deflection of the shaft 13 does not compromise the clearance between the axially facing sealing surfaces and sealing walls, the latter thereby performing the primary sealing function for keeping discharge liquid from leaking between the shrouds and the sealing rings back to the impeller inlet.

I claim:

1. In a double suction, high-speed, centrifugal pump including a housing, a shaft journaled for rotation within said housing, an impeller chamber located within said housing, inlet and outlet means for said chamber, an impeller body fixed to said shaft within said chamber, first and second sets of impeller blades fixed to opposite sides of said body for rotation with said shaft to pump fluid from said inlet means to said outlet means, first and second shrouds integrally formed with said first and second sets of blades, respectively, and first and second sealing rings associated with said first and second shrouds, respectively, said rings being mounted within said chamber and held against rotation with said impeller, the improvement comprising a first set of two sealing surfaces on said first shroud, said surfaces in said first set being spaced axially from each other and extending in a radial direction and facing in a first axial direction, a second similar set of sealing surfaces on said second shroud facing in the opposite axial direction, first and second sets of sealing walls on said first and second sealing rings and associated with said first and second sets of sealing surfaces respectively, said associated sealing surfaces and walls extending parallel to and facing each other and being spaced from each other a fixed axial distance, a cylindrical surface formed in each of said shrouds in each of said sets concentric with said shaft and being connected between said two sealing surfaces of said sets, an axially extending cylindrical wall formed in each of said sealing rings and connected between said two sealing walls in each set, said cylindrical walls normally being spaced radially outward from said cylindrical surfaces a distance greater than said fixed axial distance between said associated sealing surfaces and sealing walls, means associated with one of said sealing rings for precisely adjusting the axial distance between said first and second sets of sealing walls, and adjustable means connectable between said shaft and said housing for precisely locating said impeller within said chamber when assembling said pump so that the axial distance between said first set of sealing surfaces and said first set of sealing walls is substantially the same as the axial distance between said second set of sealing surfaces and said second set of sealing walls to keep fluid from leaking substantially from said outlet means to said inlet means by flowing between said sealing surfaces and walls.

2. In a double suction, high-speed centrifugal pump as defined by claim 1 the improvement further comprising said means associated with said sealing wall means including shim means associated with one of said sealing rings.

* * * * *